US006399153B1

(12) United States Patent
Kephart

(10) Patent No.: US 6,399,153 B1
(45) Date of Patent: Jun. 4, 2002

(54) METHOD AND APPARATUS FOR AIR MASKING PORTION OF COMPONENT DURING PLATING OR COATING

(75) Inventor: Ryan K. Kephart, Murphy, NC (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/702,250

(22) Filed: Oct. 31, 2000

(51) Int. Cl.[7] ..... B05D 1/32; B05D 1/18; C25D 5/02

(52) U.S. Cl. ..... 427/282; 427/287; 427/430.1; 427/436; 427/443.2; 205/118; 205/128; 205/135; 205/136

(58) Field of Search ..... 427/430.1, 282, 427/287, 436, 443.2; 205/118, 128, 135, 136; 118/503, 504, 505, 406

(56) References Cited

U.S. PATENT DOCUMENTS 2,262,045 A * 11/1941 Pollitt ..... 91/46
4,460,620 A * 7/1984 Deters ..... 427/58
5,665,217 A * 9/1997 Gruver et al. ..... 205/110

FOREIGN PATENT DOCUMENTS

JP 60-14968 A * 1/1985

* cited by examiner

*Primary Examiner*—Michael Barr
(74) *Attorney, Agent, or Firm*—Ostrager Chong & Flaherty LLP

(57) ABSTRACT

A method and an apparatus for restricting the areas of contact between components to be plated or coated and liquid solutions containing plating or coating agents, without the use of masking tape. Components made of electrically conductive material are suspended underneath a hood or bell housing which is sized and shaped to receive those portions of the components that should not be plated (or coated). Then the suspended components and the hood or bell housing are fully immersed in a bath of plating (or coating) solution, forming an air pocket under the hood or bell housing. This air pocket surrounds those portions of the components which are not to be plated (or coated) and prevents the liquid solution in the bath from touching those portions. The air acts as a mask that prevents paint or metal from contacting or adhering to surfaces not to be plated (or coated).

17 Claims, 3 Drawing Sheets

METHOD AND APPARATUS FOR AIR MASKING PORTION OF COMPONENT DURING PLATING OR COATING

FIELD OF THE INVENTION

This invention generally relates to electro-plating or electro-coating of components. In particular, the invention relates to means for masking areas on components to be plated or coated.

BACKGROUND OF THE INVENTION

In the plating and coating industries, unpainted metal components are hung on metal racks for conducting electricity to the components during painting or coating. In the case of coating operations, the metal rack is moved to a position overlying a tank filled with water-based painting or coating solution. In the case of plating operations, the tank is filled with electrolyte solution. The suspended components are immersed in the solution by lowering the metal rack using conventional equipment. When a dc voltage is applied across the metal rack and the tank, the components on the rack become electrified, with the fluid being positive and the components being negative. As a result of the applied voltage, an electrical current is produced through the solution and components. For coating operations, this electrical current activates the organics of the paint or coating material and makes that material "draw" to the unpainted surface areas of the components. As the plating material "draws", it coats the component. For plating operations, metal or alloy is electrolytically deposited on the immersed component surfaces.

The only surface areas not coated with paint or plated with metal during coating or plating will be those submerged areas of the component where a mask has been applied. One known type of masking material is tape designed to withstand the high temperatures which occur in a coating or plating bath. The masked surface areas will not be coated or plated because the mask blocks contact of the liquid coating or plating solution with those surface areas of the component.

In the electro-coating and electro-plating industries, many different styles of expensive masking have been developed and used. The particular masking used depends on the particular plating or coating operation. For example, in two-cycle internal combustion engines, it is known to plate the side faces of the connecting rods at their crank ends with silver. This silver plating will then bear the frictional rubbing contact with the crank faces of the crank arms or disks of the crankshaft.

One known method for applying silver plating to the side faces of the crank end of a connecting rod involves the following steps. First, the connecting rod is subjected to electro-coating, i.e., electrodeposition painting. In electrodeposition painting, paint is suspended in water in particulate form and then charged with either positive or negative electricity. Connecting rods are immersed into the fluid and then charged with the opposite polarity of electricity. This will then excite the paint and draw it to the unpainted areas of the connecting rod and cause the paint to "coat" the connecting rod to a specified thickness according to the time and amperage applied to the components/paint. The connecting rods then baked to "cure" the paint and make it extremely hard. The paint acts like an insulator to prevent the silver from adhering to exposed metal surfaces. After painting, the metal surfaces on the connecting rod which need to be silver plated are "reexposed" by running the connecting rod through a grinder. Both ends of the connecting rod have the same thickness and when the rod goes through the grinder, the grinder exposes not only the large end faces of the crank end of the connecting rod but also the small end faces of the piston end of the rod which is coupled to a wrist pin. When the connecting rod is plated after the grinding operation, the painted surfaces will not be plated while all re-exposed metal surfaces will be plated. This is undesirable, however, because the presence of silver plating on the small wrist pin end of the connecting rod serves no purpose. It also costs extra money by using additional silver metal, which is expensive.

Thus, in the specific situation just described, and other situations, there is a need for a method of silver plating which would allow the component manufacturer to apply silver to less than all of the exposed metal surfaces of the component. More generally, when plating or coating is done in narrow deep tanks, the quantity of components being plated/coated must be maximized by totally immersing successive rows of components. In the case of a narrow deep tank, the surface of the plating or coating solution has insufficient area to allow productive plating or coating by immersing the components only partially. The depths of a deep tank must also be efficiently utilized. In systems having narrow deep tanks, there is a need for a technique and for equipment which would allow only certain portions of fully immersed components to be plated or coated. In particular, there is need for an alternative to the use of expensive masking tape that is not re-usable, which masking technique adds permanent costs without added value to the components to be plated.

SUMMARY OF THE INVENTION

The present invention is directed to a method and an apparatus for restricting the areas of contact between components to be plated or coated and liquid solutions containing plating or coating agents, without the use of masking tape. In accordance with the preferred embodiments of the invention, components are suspended underneath a concave structure, with portions of the components that should not be plated (or coated) being disposed within the interior volume defined by the concave structure. Then the suspended components and the concave structure are fully immersed in a bath of plating (or coating) solution. The concave structure is disposed so that air is trapped under it when the structure is immersed in the liquid solution. The resulting air pocket surrounds the portions of the components which are not to be plated (or coated), prevents the liquid solution in the bath from entering the interior volume of the concave structure and touching those portions. In other words, the air acts as a "blind" or mask that prevents paint or metal from contacting or adhering to surfaces not to be plated (or coated).

A method of coating or plating in accordance with one preferred embodiment of the invention comprises the steps of: placing a component made of electrically conductive material in a position relative to a concave structure such that a portion of the component protrudes inside the concave structure; immersing the component and the concave structure in a solution containing plating or coating material so that an air pocket is formed beneath the concave structure; and plating or coating only the portion of the component which protrudes outside the concave structure.

A system for plating or coating in accordance with another preferred embodiment comprises: a rack; an electrically conductive mounting supported by the rack; an electrically conductive component coupled to and in contact with the mounting; a concave structure supported by the rack, the concave structure being configured and positioned so that one portion of the component protrudes outside and another portion of the component protrudes inside the concave structure; and a tank holding a solution containing plating or coating material. The component and the concave structure are immersed in the solution with an air pocket trapped beneath the concave structure. Only the exposed surfaces of the component lying outside the concave structure are plated or coated.

A further aspect of the invention is directed to a method of masking a portion of a component to be plated or coated by covering that portion of the component with a buffer or pocket of air.

In accordance with the preferred embodiment of the invention, the concave structure referred to above takes the form of a bell housing having one end attached to a rack. In most cases the fluid buffer under the bell housing will comprise ambient air. However, the invention does not require the use of air. For example, in some situations, it may be preferable to fill the space under the bell housing with inert gas.

The invention has application in electro-plating or electro-coating any components which can be suspended under a concave hood or bell housing or similar concave structure. The hood or bell housing can be specifically designed to meet the needs of a particular application. The hood or bell housing must have an interior volume sized and shaped to receive the portions of a multiplicity of components which are not to be plated or coated. Multiple hoods or bell housings can be mounted on a circulating rack system which immerses multiple rows of components in the plating or coating bath at the same time.

This application is extremely unique as most masking agents or materials are required to be applied singly to each part and require some manual application and removal. With this type of housing, the parts can be loaded as fast as if there were no housing at all. In addition, the masking requirements can be completely bypassed. This saves the cost of the masking and the time involved with the application/removal of the masks.

DETAILED DESCRIPTION OF THE PREFERRED EMBODIMENTS

Figure 1:
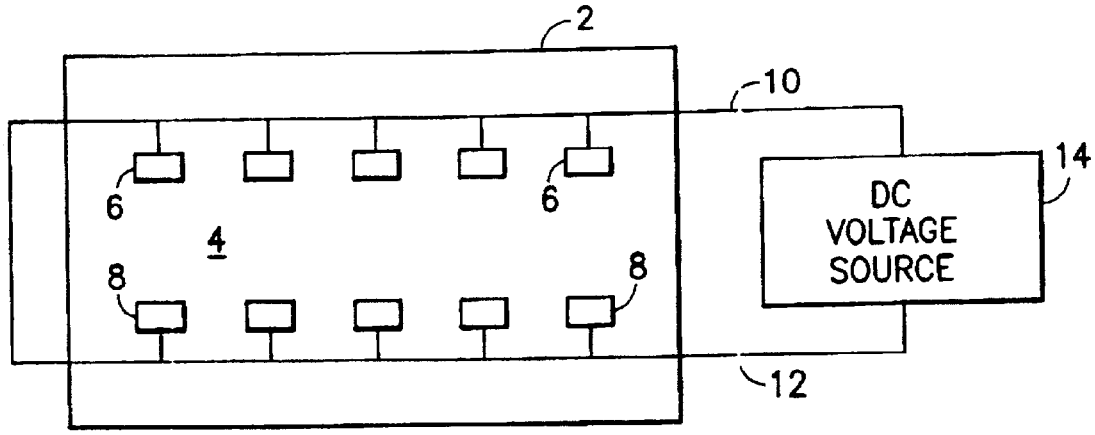
FIG. 1 is a schematic showing a tank top view of typical connections for a simple electroplating process.

FIG. 1 shows typical connections for a simple electroplating system. A tank 2 is filled with electrolyte solution 4. A multiplicity of metal articles or components 6 to be plated are suspended from a rack and immersed in the electrolyte solution 4. Each component 6 is electrically connected to a cathode bus bar 10. In addition, a multiplicity of anodes 8 are immersed in the electrolyte solution. Each anode 6 is electrically connected to an anode bus bar 12. One end of the cathode bus bar 10 is connected to one terminal of a source 14 of dc voltage; one end of the anode bus bar 12 is connected to the other terminal of the dc voltage source 14. The other ends of the anode and cathode bus bars are connected to each other. When a voltage potential is established between the anodes and the components to be plated is connected, metal or alloy is electrolytically deposited on the immersed surfaces of the metal components 6, which are connected as the cathodes in the electrolyte solution. Direct current is introduced through the anodes, which consist of the metal to be deposited.

In accordance with the preferred embodiments of the invention, components made of electrically conductive material are suspended underneath a concave structure, such as a hood or bell housing. The hood or bell housing is sized and shaped to define an interior volume which receives the portions of the components that should not be plated (or coated). Then the suspended components and the hood or bell housing are fully immersed in a bath of plating (or coating) solution. The hood or bell housing is disposed so that air is trapped under it when the hood or bell housing is immersed in the liquid plating (or coating) solution. The resulting air pocket surrounds those portions of the components which are not to be plated (or coated) and prevents the liquid solution in the bath from touching those portions. As a result, the paint or metal is prevented from contacting or adhering to surfaces where plating (or coating) is not desired.

Figure 2:
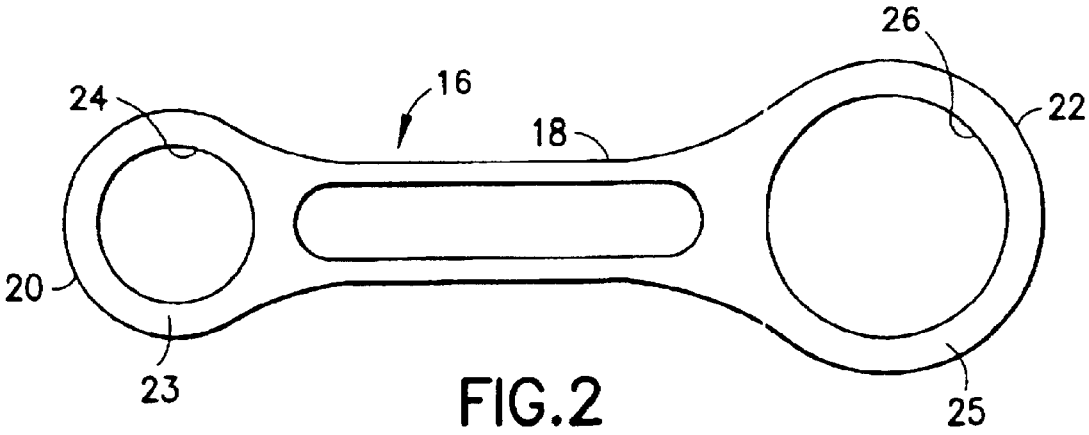
FIG. 2 is a schematic showing a side view of a typical connecting rod used in an outboard marine engine.

To provide an illustration of the masking technique according to the preferred embodiment, the example of a connecting rod requiring silver plating on the side faces of its crank end will again be employed. As previously described, the connecting rod is first painted and then the paint is removed from the side faces by grinding. The object of the plating operation is to plate the exposed side faces on the crank end, but to not plate the side faces on the piston end of the connecting rod. The structure of a typical connecting rod is depicted in FIG. 2. The connecting rod 16 comprises an elongated main body 18 connected at one end to a wrist pin portion 20 and at the other end to a crank pin portion 22. The crank pin portion 22 includes a cylindrical surface 26 which surrounds and engages an associated bearing assembly mounted to the crankshaft (not shown). Similarly, the wrist pin portion 20 includes a cylindrical surface 24 which surrounds and engages a bearing assembly (not shown) which, in turn, surrounds and engages the associated wrist pin (not shown).

The annular surface area 25 on the crank pin portion 22 is referred herein as a side face on the crank end of the connecting rod. The opposing side (not visible in FIG. 2) of the crank pin portion 22 has an identical side face. These are the side faces which need to be plated because they bear against opposing faces on the crankshaft during crankshaft rotation. Similarly, the annular surface area 23 on the wrist pin portion 20 is referred herein as a side face on the piston end of the connecting rod. The opposing side (not visible in FIG. 2) of the wrist pin portion 22 has an identical side face. These are the side faces which do not need to be plated.

Figure 3:
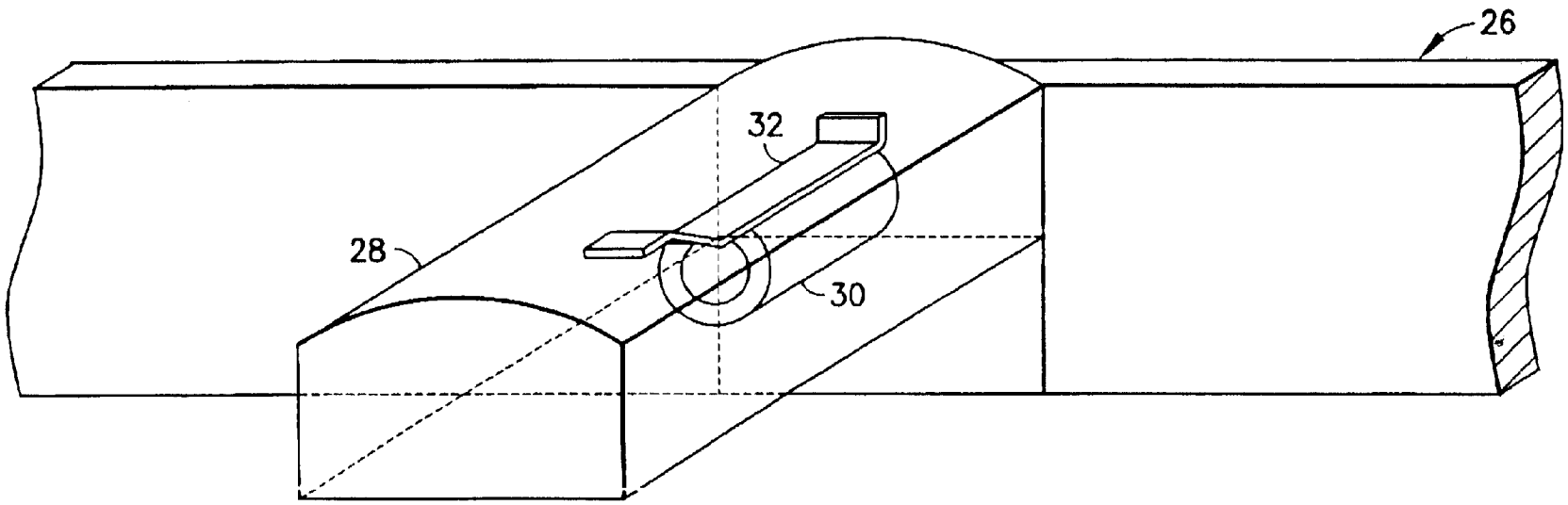
FIG. 3 is a schematic showing an isometric view of a bell housing air mask arrangement in accordance with one preferred embodiment of the invention.
Figure 4:
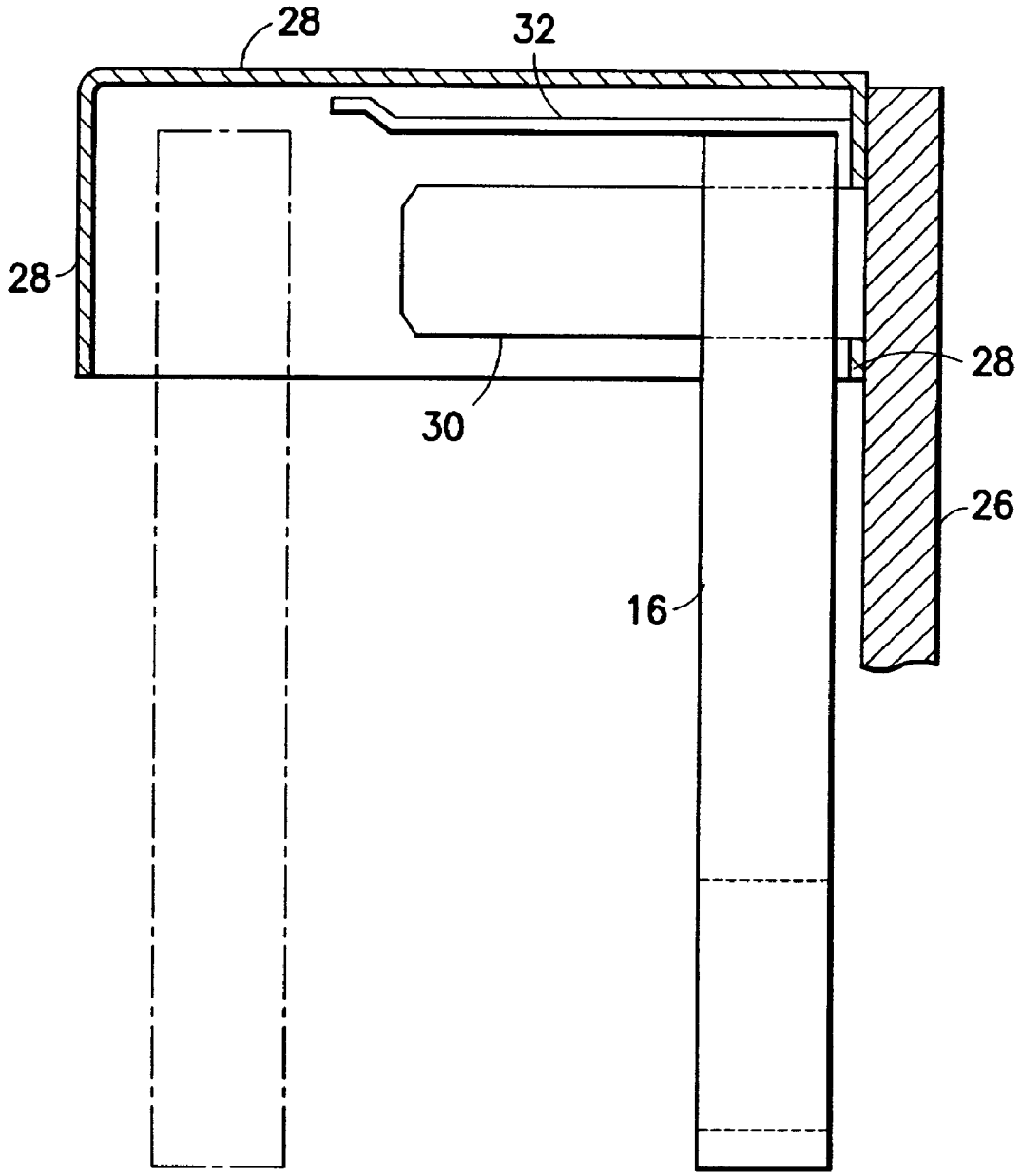
FIG. 4 is a schematic showing a side elevational view of the arrangement shown in FIG. 3, with a connecting rod shown mounted inside the bell housing.

In accordance with an exemplary preferred embodiment, a multiplicity of connecting rods of the type shown in FIG. 2 can be plated in a tank of electrolyte solution using the apparatus depicted in FIGS. 3 and 4. The apparatus comprises a rack which supports the components to be plated and which is movable into and out of the electrolytic bath by conventional mechanized means (not shown). Only a cross bar 26 of the rack is shown in FIGS. 3 and 4. In accordance with the provided embodiment, the cross bar 26 supports a bell housing 28, which may be made of metal, silicone rubber or any other material which has sufficient structural strength and sufficient resistance to the chemicals in the bath. In this example, the bell housing 28 is a five-sided hood having a generally rectangular inlet opening defined by the lower edges of the four sides. The roof of the bell housing can be flat or curved. The bell housing shown in FIGS. 3 and 4 is supported by the rack at only one end of the housing, with the remainder of the housing extending in cantilever fashion from the cross bar 26.

The apparatus shown in FIGS. 3 and 4 further comprises a mounting post 30 comprising a circular cylindrical tube (or solid rod) made of electrically conductive material. The mounting post 30 is also attached at one end to the rack cross bar 26, with the remainder of the post extending in cantilever fashion from the cross bar. The mounting post 30 is specifically designed to support a row of connecting rods suspended therefrom. Only one connecting rod 16 is shown in FIG. 4. More particularly, the outer diameter of the mounting post 30 must be less than the inner diameter of the circular opening formed by cylindrical surface 24 on the wrist pin portion 20 of the connecting rod, with sufficient clearance to allow the wrist pin portion of the connecting rod to be slid easily over and along the mounting post. Optionally, the peripheral edge of the end of the mounting post may be chambered to facilitate entry of the post through the opening in the connecting rod. In this manner, the connecting rods can be hung on the mounting post in a row, each connecting rod extending vertically downward under the force of gravity.

The connecting rod is held in place on the mounting post 30 by a tension clip 32 which has one end mounted to the bell housing (or to the rack cross bar) and extends in cantilever fashion along and adjacent the mounting post. The tension clip 32 is preferably made of spring material and flexes away from the mounting post 30 when deflected upward by a connecting rod 16 sliding onto the mounting post. This flexure tensions the clip, causing the clip to press against the top of the connecting rod 16. Multiple connecting rods can be slid onto the mounting post and held in place by the tension clip.

When a full complement of connecting rods have been suspended from the mounting post, the entire assembly is immersed in the tank of plating or coating solution. This can be accomplished in an automated fashion by providing a circulating rack which travels along tracks which descend into the tank. Preferably the bell housing 26 is mounted on the cross bar 28 of the rack with an angular orientation such that the lower edge of the housing is generally parallel to the top surface of the solution as the bell housing enters the liquid during rack descent. The downward descent of the concave housing as the lower edge enters the liquid causes ambient air to be trapped under and inside the housing. The bell housing must be designed to have an interior volume of sufficient depth that the entire surface of the component which is not to be plated lies within the pocket of trapped air and does not contact the plating or coating solution during immersion. Only those portions of the components which protrude outside of the bell housing will come into contact with the plating or coating solution. In the case of the connecting rod shown in FIG. 4, the connecting surfaces are coated with electrically insulating paint, except for the side faces 23 and 25 (see FIG. 2), which have been subjected to grinding to remove the paint layer, as previously described. In this example, the depth of the bell housing 26 must be selected so that the entirety of the exposed side faces 23 on the wrist end portion of the connecting rod lie within the air pocket and are not contacted by the silver plating solution, while the entirety of the exposed side faces 25 on the crank pin portion of the connecting rod lie outside the air pocket and are contacted by the silver plating solution. The result is that end faces 25 are plated with silver and end faces 23 are not during the plating operation.

Multiple rows of components partly covered by a respective hood or bell housing for each row can be immersed in the plating or coating solution concurrently. For example, multiple spaced racks, each rack supporting a row of components covered by a hood or housing, can travel along dual U-shaped tracks immersed in the plating or coating solution held in a narrow, deep tank. This arrangement allows many more components to be concurrently only partially plated than would be the case if partial plating were achieved by partly immersing the components at the surface of the solution, since the amount of solution surface in a narrow tank is limited.

It should be appreciated that the mounting post disclosed above is specific to the plating of connecting rods. Persons skilled in the art will recognize that the structure of any mounting means will necessarily be a function of the structure of the component being suspended under the hood or bell housing. Similarly, the rack may have different designs depending on the weight, size and shape of the suspended components. The disclosure of a linear rack cross bar supporting a horizontal cantilevered mounting post is merely one example of a support structure. The invention is not limited in any sense with regard to the types and designs of support structures which can be used in combination with a concave hood or bell housing for air masking components to be plated or coated.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claim is:

1. A method of coating or plating a portion of a component made of electrically conductive material, comprising the steps of:

filling a tank with a plating or coating solution;

suspending a component made of electrically conductive material from an electrically conductive support structure located inside an interior volume of a concave structure, with a lower portion of said component extending downward from and protruding outside said interior volume and an upper portion of said component being located inside said interior volume;

immersing said component and said concave structure in said solution, said concave structure being disposed during immersion such that an air pocket, bounded in part by said solution and surrounding said upper portion of said component, is formed in said interior volume; and electro-plating or electro-coating a portion of a surface of said lower portion of said component while not plating or coating said upper portion of said component.

2. The method as recited in claim 1, wherein said electroplating or electro-coating step comprises passing direct current from said solution to said component.

3. The method as recited in claim 1, wherein said plating or coating material is metal.

4. The method as recited in claim 1, wherein said plating or coating material is pigment.

5. The method as recited in claim 1, wherein said upper portion of said component comprises an opening, and said mounting step comprises the step of passing a portion of said support structure through said opening.

6. The method as recited in claim 1, wherein said Immersing step comprises the step of lowering said support structure into said solution.

7. A method of coating or plating a portion of a component made of electrically conductive material, comprising the steps of:

painting said component with electrically Insulating material;

removing said electrically insulating material from a first area on an upper portion of said component and from a second area on a lower portion of said component;

arranging said component in relation to a concave structure so that said upper portion of said component lies underneath and inside said concave structure;

filling a tank with a plating or coating solution;

immersing said lower portion of said component an d said concave structure in said solution, said concave structure being disposed during immersion such that an air pocket, bounded in part by said solution and surrounding said upper portion of said component, is formed beneath said concave structure; and electro-plating or electro-coating said second area on said lower portion of said component while not plating or coating said first area on said upper portion of said component.

8. The method as recited in claim 7, wherein said component is a connecting rod having a first opening in a first end of said upper portion and a second opening in a second end of said lower portion.

9. The method as recited in claim 8, wherein said first area is a first side face on a periphery of said first opening and said second area is a second side face on a periphery of said second opening.

10. The method a s recited in claim 7, wherein said second area is plated with silver.

11. The method as recited in claim 9, wherein said second si de face is plated with silver.

12. The method as recited in claim 7, wherein said arranging step comprises the step of mounting an end of said upper portion of said component to an electrically conductive structure located inside said concave structure.

13. The method as recited in claim 12, wherein said end of said another portion of said component comprises an opening, and said mounting step comprises the step of sliding said open end of said component onto a mounting post.

14. A method of coating or plating portions of components made of electrically conductive material, comprising the steps of:

painting said components with electrically insulating material;

removing said electrically insulating material from a respective first area on a respective upper portion of each of said components and from a respective second area on a respective lower portion of each of said components;

arranging a support member made of electrically conductive material underneath a concave structure and inside a volume defined by said concave structure;

suspending said components from said support member, said lower portions of said components depending downward and lying outside of said volume defined by said concave structure;

filling a tank with a plating or coating solution;

immersing said lower portions of said components and said concave structure in said solution, said concave structure being disposed during immersion such that an air pocket, bounded in part by said solution and surrounding said upper portions of said components, is formed beneath said concave structure; and electro-plating or electro-coating said second areas on said lower portions of said components while not plating or coating said first areas on said upper portions of said components.

15. The method as recited in claim 14, wherein each of said components is a connecting rod having a first opening in a first end of said upper portion and a second opening in a second end of said lower portion, wherein said suspending step comprises passing said support member through said first opening of each of said components in sequence.

16. The method as recited in claim 14, wherein said second areas are plated with silver.

17. A method for plating or coating a plurality of connecting rods in one operation, each of said connecting rods being made of electrically conductive material and comprising a crank end having a first opening with opposing side surfaces and a piston end having a second opening with opposing side surfaces, comprising the following steps:

covering the outer surface of each of said connecting rods with electrically insulating paint;

removing said paint on all of said side surfaces;

arranging said plurality of connecting rods in side-by-side relationship under a hood with said crank ends protruding outside of a volume defined by said hood and with said piston ends inside said volume;

lowering said plurality of connecting rods and said hood into a plating or coating solution, said hood being disposed during immersion in said solution so as to form an air pocket inside said volume; and electro-plating or electro-coating said opposing side surfaces on said crank end while not plating or coating said opposing side surfaces on said piston end.

* * * * *